US005971534A

United States Patent [19]

Sasaki et al.

[11] Patent Number: 5,971,534

[45] Date of Patent: Oct. 26, 1999

[54] INK CARTRIDGE LOADING MECHANISM FOR A PRINTER AND A PRINTER HAVING THE LOADING MECHANISM

[75] Inventors: Toshiyuki Sasaki; Hiroyuki Nakayama; Hideki Kawakami; Masashi Fujikawa, all of Nagano, Japan

[73] Assignee: Seiko Epson Corporation, Tokyo, Japan

[21] Appl. No.: 09/054,139

[22] Filed: Apr. 2, 1998

[30] Foreign Application Priority Data

Apr. 2, 1997 [JP] Japan ..... 9-084235

[51] Int. Cl.[6] ..... B41J 2/175

[52] U.S. Cl. ..... 347/86

[58] Field of Search ..... 347/84, 85, 86, 347/87, 49

[56] References Cited

FOREIGN PATENT DOCUMENTS 0 536 832 B1 3/1998 European Pat. Off. .

*Primary Examiner*—N. Le
*Assistant Examiner*—Michael Nghiem
*Attorney, Agent, or Firm*—Fish & Richardson P.C.

[57] ABSTRACT

An ink cartridge loading mechanism for a printer is disclosed for lessening the space required to place or replace an ink cartridge in an ink jet printer. To place an ink cartridge 20 in an ink cartridge loading mechanism 10 of a printer, first the ink cartridge 20 is pushed into a receptacle section 50 vertically from the top. Next, an operation lever 65 of a slide mechanism 60 is turned to slide the receptacle section 50 into contact with an ink supply needle 31 horizontally. As a result, a loading state in which the ink supply needle 31 is completely inserted into an ink supply port of the ink cartridge 20 is formed. A large amount of space in the direction of loading of the ink cartridge is not needed. Therefore, there are fewer restrictions on the location of the printer and the amount of space needed for the printer is reduced.

21 Claims, 8 Drawing Sheets

INK CARTRIDGE LOADING MECHANISM FOR A PRINTER AND A PRINTER HAVING THE LOADING MECHANISM

FIELD OF THE INVENTION

The present invention relates to an ink cartridge loading mechanism for a printer comprising an ink jet head section and to a printer having such a loading mechanism.

BACKGROUND OF THE INVENTION

Printers are known which comprise an ink jet head section wherein an ink cartridge is used to supply ink to the ink jet head section. In such printers, when the ink cartridge becomes empty, it can be replaced with a full one. An ink cartridge loading mechanism comprises an ink supply needle placed at a fixed position and an ink cartridge is placed in such a manner that the ink supply needle is inserted into an ink supply port of the ink cartridge.

An ink cartridge of the structure disclosed in Japanese Laid-Open Patent No. Hei 5-16378 by the present applicant is known. This ink cartridge consists of a flexible ink bag in which ink is sealed, an ink supply port leading from the ink bag, and a hard plastic case containing the ink bag. Generally, the plastic case is shaped like a flat rectangular parallelopiped and the ink supply port leading from the ink bag is exposed to the front end face of the plastic case. Therefore, the ink cartridge is placed in such a manner that the ink supply needle of the printer is inserted into the ink supply port of the ink cartridge.

To insert the ink supply needle into the ink supply port in an appropriate fashion and attach the ink supply needle, the ink cartridge needs to be moved in a sliding fashion in the direction of the needle. Generally, an ink cartridge loading part is disposed in the front or rear portion of the printer and the ink cartridge is slidable horizontally from the front or rear side, whereby it can be attached or detached.

However, in such a loading mechanism for sliding the ink cartridge in one direction from the front or rear side of the printer, it is necessary to open widely the portion of the printer having the loading mechanism. Thus, the following problems are involved:

First, in a printer adapted to replace an ink cartridge therein from the rear, the printer cannot be installed near or on a wall. In such a case, even if the footprint of the printer itself is small, a large installation space for the printer is nonetheless required.

On the other hand, in a printer adapted to replace an ink cartridge therein from the front, accessories and other equipment related to the printer cannot be placed on the front face of the printer. For example, with a printer used for POS application, input units such as a tablet, a keyboard, and a scanner and a display unit for displaying data, etc., entered through the input units may be placed in front of the printer. Thus, the printer adapted to replace an ink cartridge therein from the front requires that the accessories should be moved away when an ink cartridge is replaced; such an arrangement is not preferred from the viewpoint of ease of use.

SUMMARY OF THE INVENTION

Thus, the conventional printer's ink cartridge loading mechanism involves solving the problems that the printer installation area is restricted in size but that a large printer installation space is required. It is therefore an object of the invention to provide an ink cartridge loading mechanism for a printer that requires less space than the known devices.

The invention comprises an ink cartridge loading or placement mechanism for an ink jet head device that is formed so as to allow an ink cartridge to be inserted from a direction different from the axial direction of the ink supply needle which is disposed in an ink cartridge loading or reloading section of a printer, and then to be moved toward the ink supply needle, thereby lessening the space required for placing or replacing the ink cartridge as compared with placing the ink cartridge from the same direction as the ink supply needle as in the prior art.

That is, according to the invention, an ink cartridge loading mechanism is provided for a printer. It comprises a loading section for detachably arranging an ink cartridge and an ink supply needle disposed in the loading section. The ink cartridge in the loading section is arranged in such a manner that the ink supply needle is inserted into an ink supply port of the ink cartridge. The loading section further comprises a receptacle section for accepting the ink cartridge from a direction different from the axial direction of the ink supply needle. The ink supply needle can be inserted into the ink supply port by using a slide mechanism for causing the receptacle section to reciprocate in the axial direction of the ink supply needle.

In a first embodiment of the invention, the direction in which the receptacle section accepts the ink cartridge is a direction roughly orthogonal to the axial direction of the ink supply needle. Of course, it can also be a direction forming an acute angle or an obtuse angle rather than the orthogonal direction.

The slide mechanism can comprise a guide frame for slidably supporting the receptacle section, an operation lever formed pivotably on the side of the guide frame, and a mechanism for converting rotation of the operation lever into linear motion sliding the receptacle section.

More particularly, for example, the slide mechanism can comprise a guide frame for slidably supporting the receptacle section, a rack formed on the side of the receptacle section, a pinion being formed on the side of the guide frame and engaging the rack, and an operation lever extending radially from the rotation center of the pinion for rotating the pinion. If the slide mechanism is used, the receptacle section is easily slidable by a small force by lengthening the operation lever.

In addition to the slide mechanism using the rack and the pinion, for example, the slide mechanism comprising a guide frame for slidably supporting the receptacle section, a protrusion formed on the side of the receptacle section, and an operation lever being formed on the side of the guide frame and engaging the protrusion for sliding the receptacle section or the slide mechanism comprising a guide frame for slidably supporting the receptacle section, a groove-like cam formed on the side of the receptacle section, and an operation lever being formed on the side of the guide frame and having a protrusion engaging the cam can be used to slide the receptacle section.

The above-described ink cartridge disclosed in Japanese Laid-Open Patent No. Hei 5-16378 previously proposed by the present applicant can be used as the placed ink cartridge. The ink cartridge comprises a flexible ink bag in which ink is sealed, an ink supply port provided in the ink bag, and a hard case containing the ink bag.

To use the ink cartridge, preferably the ink supply needle is placed horizontally so as to decrease any ink leakage.

It is desirable to attach a lid to the opening of the receptacle section of the ink cartridge loading section so as to prevent any foreign material from entering the receptacle section when the ink cartridge has been removed. In this case, the ink cartridge loading mechanism can also include the lid to block the opening into the receptacle section in a state in which the lid can be opened in the ink cartridge acceptance direction, a spring for energizing or biasing the lid in the direction for blocking the opening, and an engagement section for holding the lid in the blocking state, and if the engagement section can be moved in a direction so that the engagement is released as the ink cartridge is pushed into the receptacle section, the lid is then opened or closed in association with the attachment or detachment of the ink cartridge.

DETAILED DESCRIPTION

Referring now to the accompanying drawings, the configuration of a printer comprising an ink cartridge loading mechanism incorporating the invention will be discussed.

Figure 1:
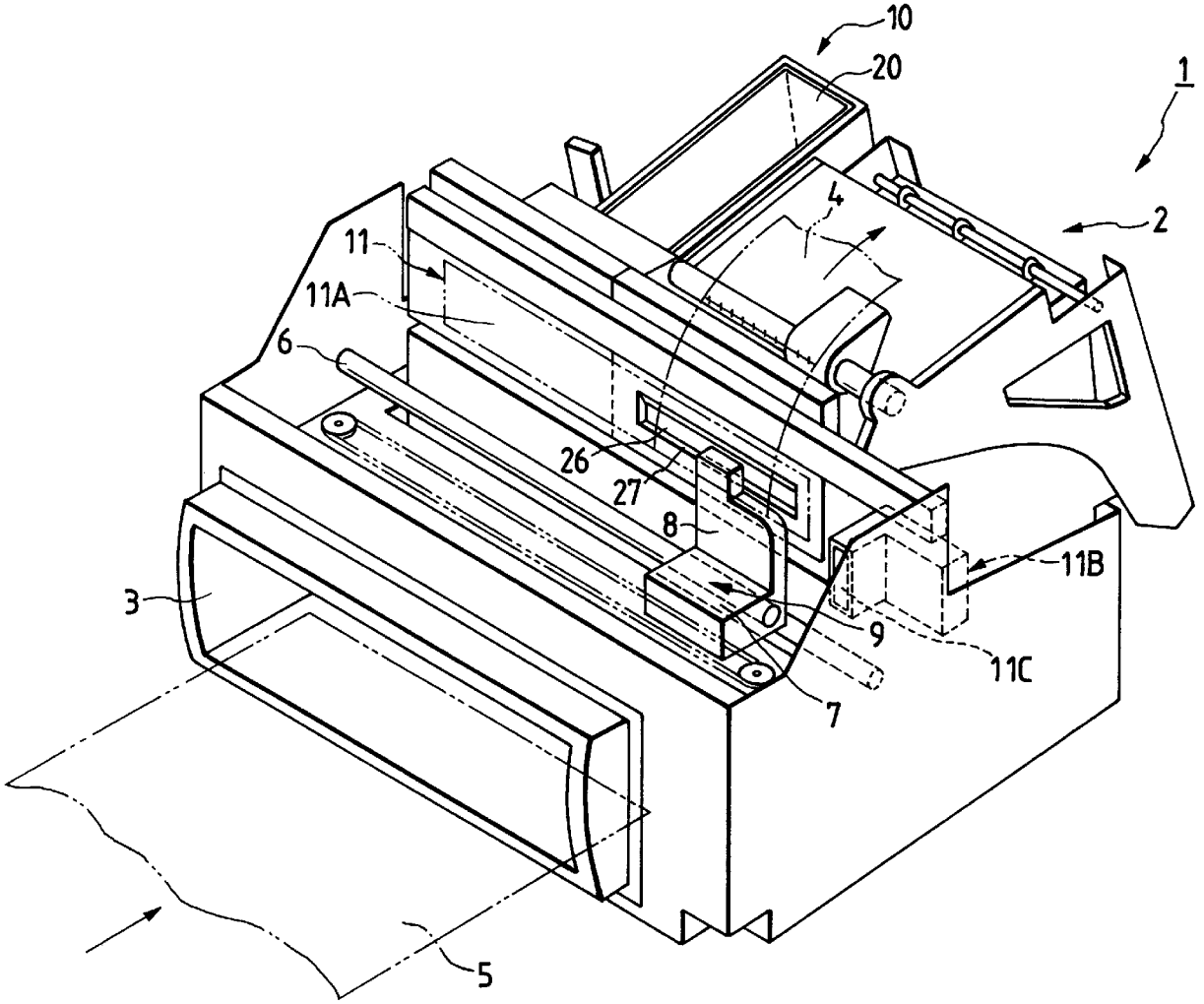
FIG. 1 is a front perspective view to show an ink jet printer incorporating the invention.
Figure 2:
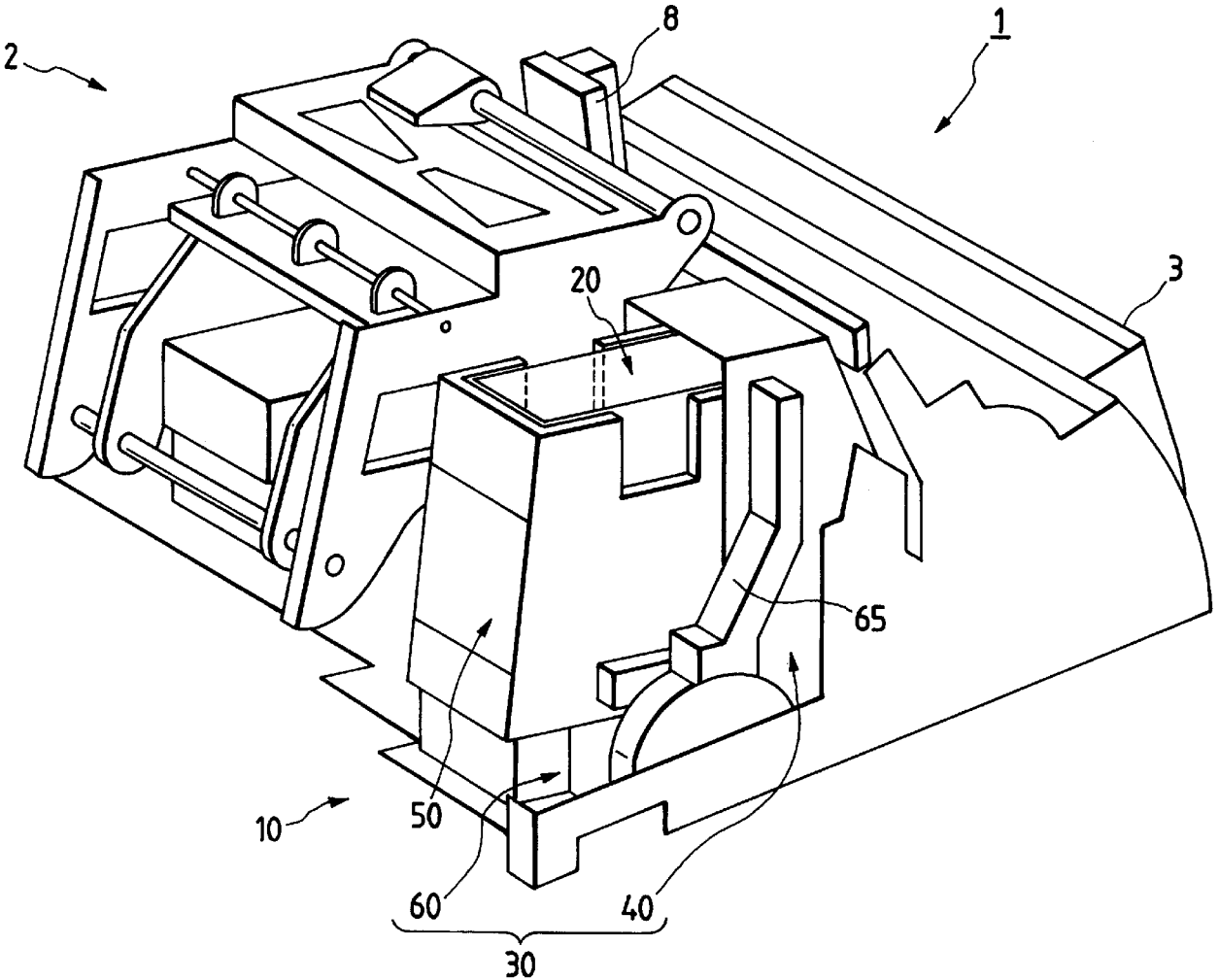
FIG. 2 is a rear perspective view to show the ink jet printer in FIG. 1.
Figure 3:
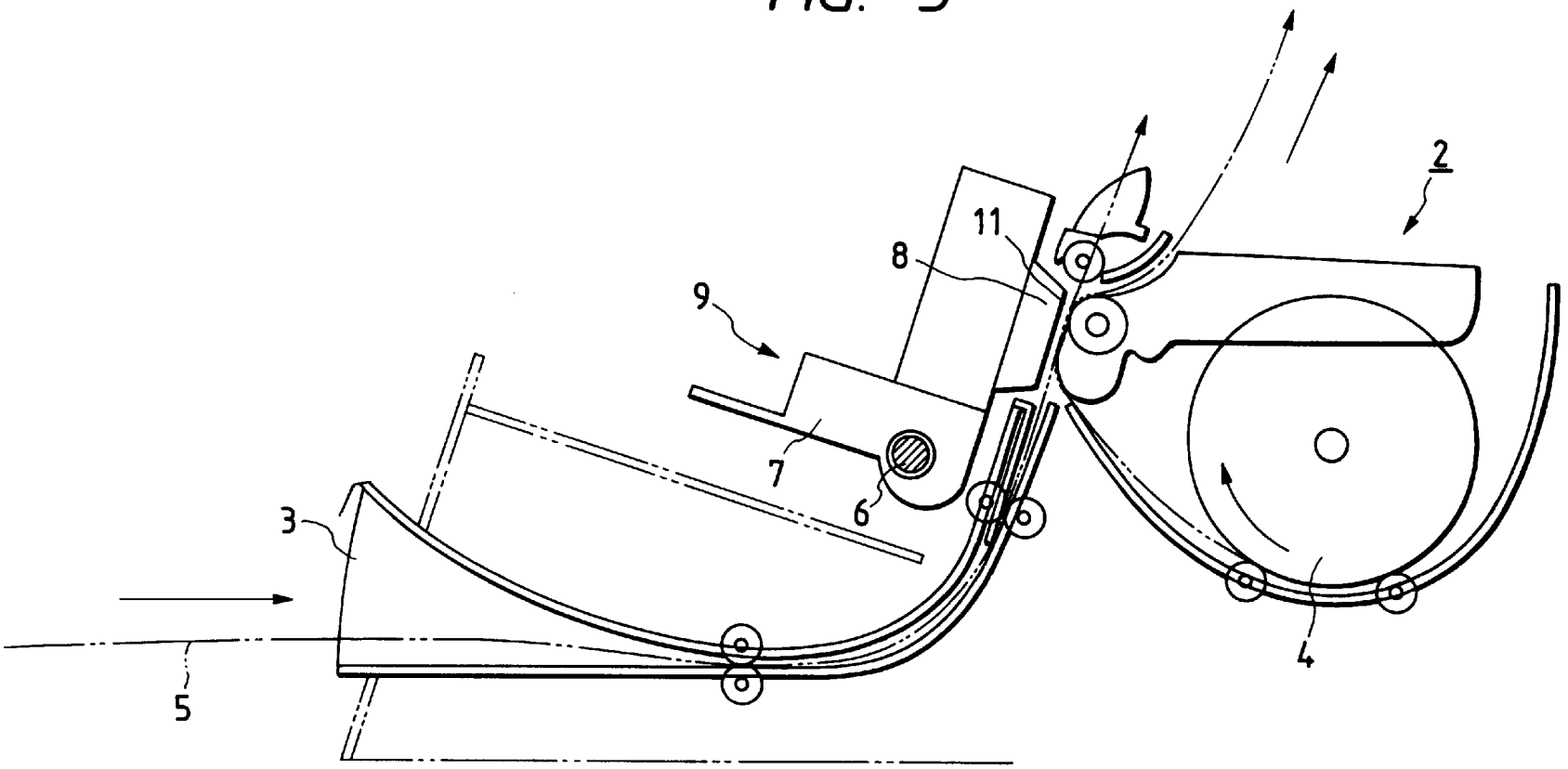
FIG. 3 is a schematic representation to show a paper transport passage in the ink jet printer in FIG. 1.

FIG. 1 and FIG. 2 are perspective views of an ink jet printer incorporating the invention from the front and rear thereof, respectively, in a slanting direction. FIG. 3 is a schematic representation to show an outline of a paper transport passage in the ink jet printer.

Referring to the figures, an ink jet printer 1 comprises a roll paper loading mechanism 2 and a paper feed port 3 of cut paper, slip paper, and the like, of any size, such as A4 or the like, and a transport passage is formed so that roll paper 4 supplied from the roll paper loading mechanism 2 and slip paper 5 inserted from the paper feed port 3 are transported through a print position 11 (area surrounded by the alternate long and short dashed line in FIG. 1). An ink jet head 8 is carried by a carriage mechanism 9 so as to face the surface of the roll paper 4 or slip paper 5 passed through the print position 11.

The carriage mechanism 9 comprises a guide shaft 6, a carriage 7 carried along the guide shaft 6 for a reciprocating motion in a direction orthogonal to the transport direction of the roll paper 4 and the slip paper 5, and a carriage driving motor (not shown).

The carriage 7 can reciprocate in the range which includes the print position 11 in the width direction thereof. A capping face 11C of a capping mechanism 11B, which is a retreat position of the ink jet 8, is placed at a position out of the print position 11 to one side in the width direction. In a standby mode of print operation, the ink jet head 8 has the nozzle face closed by the capping face 11C for preventing the ink meniscus of each ink nozzle from receding, ink from drying, and the like.

Ink is supplied to the ink jet head 8 via an ink tube (not shown) from an ink cartridge loading mechanism 10 as an ink supply section mounted at a position adjoining the roll paper loading mechanism 2. As seen in FIG. 2, the ink cartridge loading mechanism 10 comprises an ink cartridge loading section 30 in which an ink cartridge 20 is placed detachably.

Figure 4B:
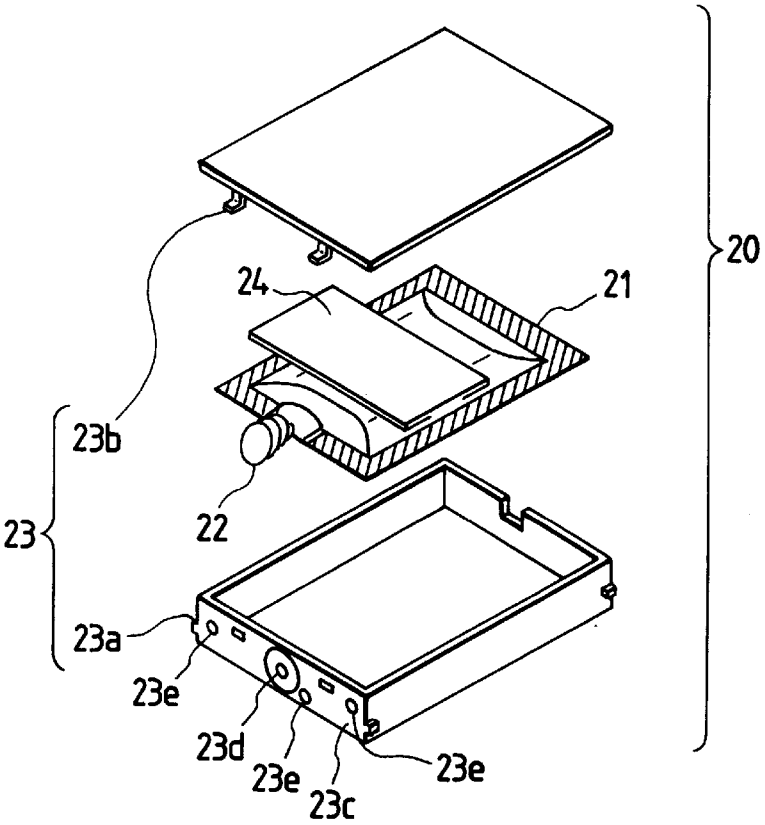
FIG. 4B illustrates the internal structure of an ink cartridge.
Figure 4A:
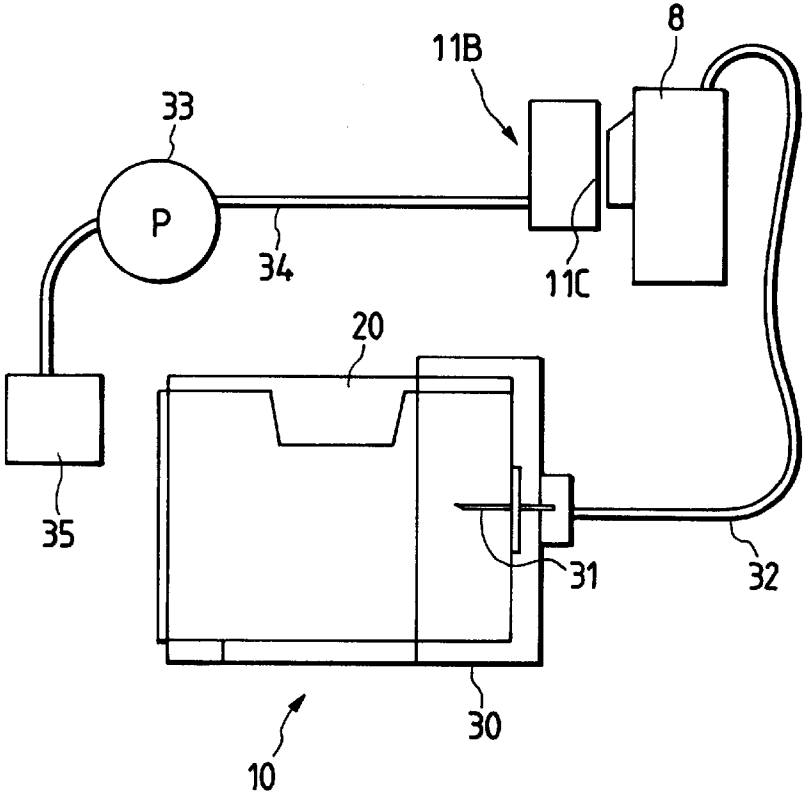
FIG. 4A is a schematic block diagram to show an ink supply channel in the ink jet printer in FIG. 1 and FIG. 4B.

Referring to FIG. 4A, an ink supply channel for supplying ink to the ink jet head 8 will be outlined. An ink supply needle 31 is placed in the ink cartridge loading section 30 of the ink cartridge loading mechanism 10, and the ink cartridge 20 is placed so that the ink supply needle 31 is completely inserted. Ink supplied from the ink cartridge 20 to the ink supply needle 31 is supplied through an ink tube 32 to the ink jet head 8. The ink jet head 8 is driven, whereby ink drops are jetted from ink nozzles (not shown) onto recording paper transporting through the print position 11. With the ink jet head 8 blocked by the capping face 11C of the capping mechanism 11B, an ink pump 33 is driven, whereby ink can be sucked from the nozzle face and be collected in a waste ink collection section 35 via a waste ink tube 34.

Next, referring to FIG. 4B, the internal structure of the ink cartridge 20 will be outlined. The ink cartridge 20 comprises a flexible ink bag 21 in which ink is sealed, an ink supply made in the ink bag 21, and a hard case 23 containing the ink bag 21. The case 23 consists of a case main body 23*a* and a case lid 23*b*. Made in the front end face 23*c* of the case 23 are a needle insertion hole 23*d* through which the ink supply needle 31 can be inserted into the ink supply from the outside of the case 23 and three ink cartridge positioning holes 23*e*. A detection plate 24 for detecting the remaining ink amount is attached to the side face of the ink bag 21.

Next, the configuration of the ink cartridge loading mechanism 10 built in the printer 1 will be discussed.

Figure 5B:
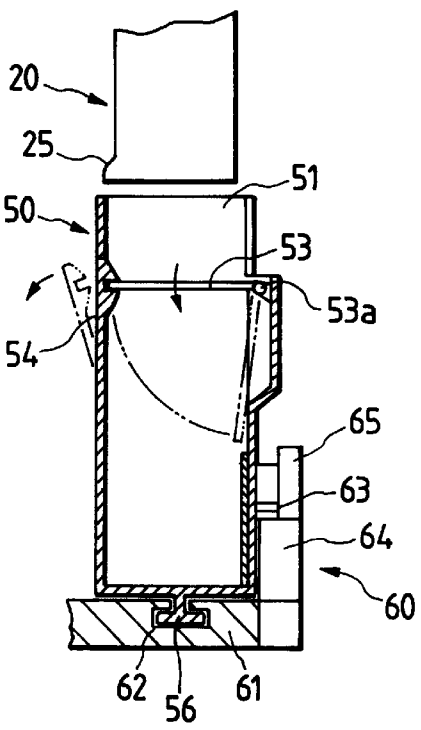
FIG. 5A is a schematic representation to show a state of an ink cartridge loading mechanism before the ink cartridge is placed therein and FIG. 5B is a partly sectioned view of FIG. 5A.
Figure 5A:
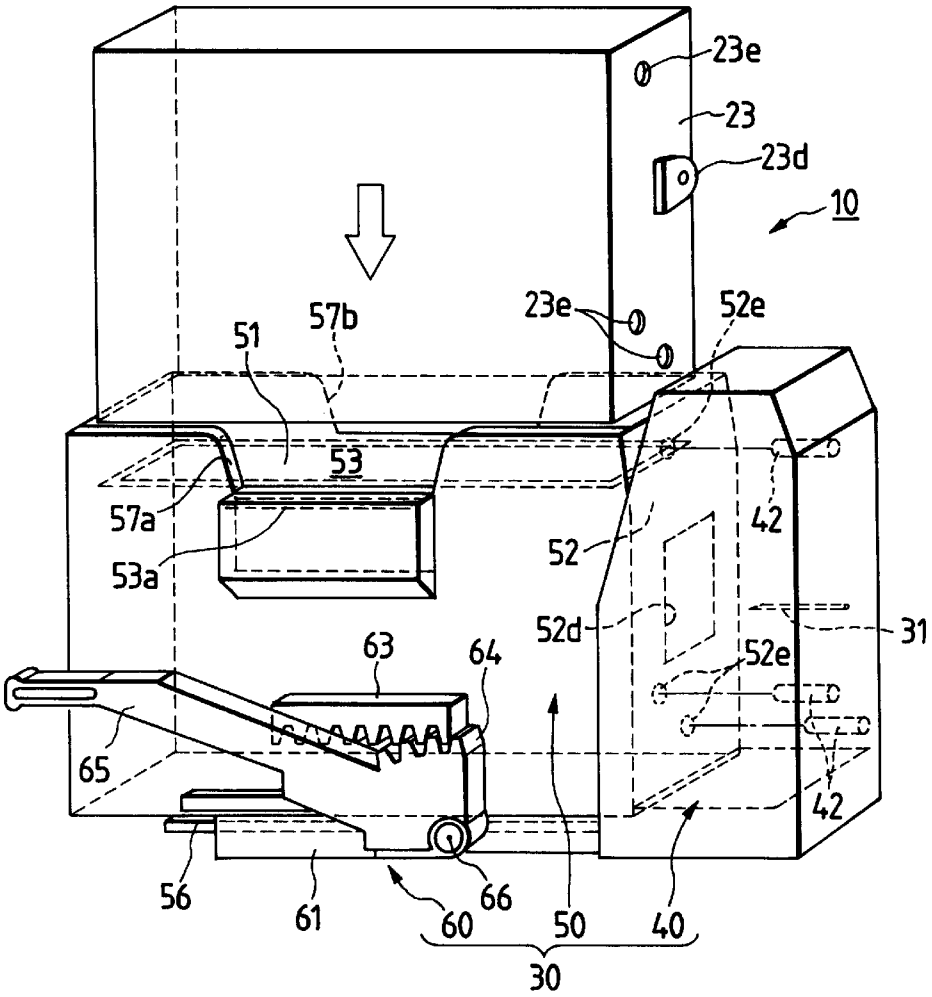
Figure 6A:
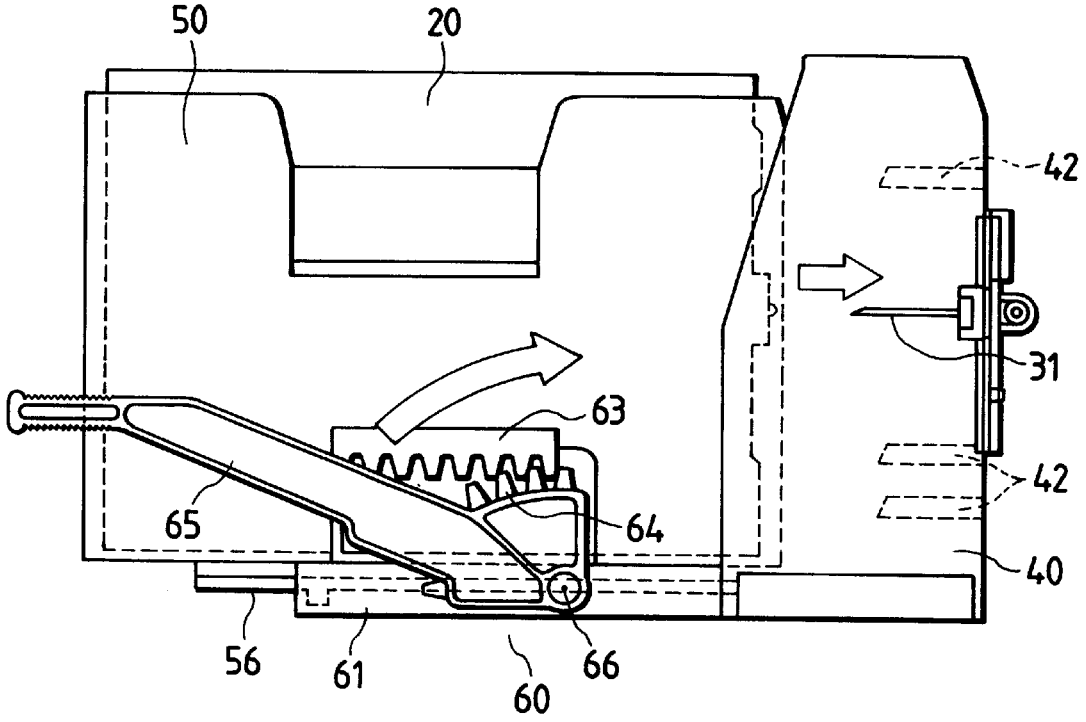
FIGS. 6A and 6B are schematic representations to explain an ink cartridge loading operation in the ink cartridge loading mechanism.
Figure 6B:
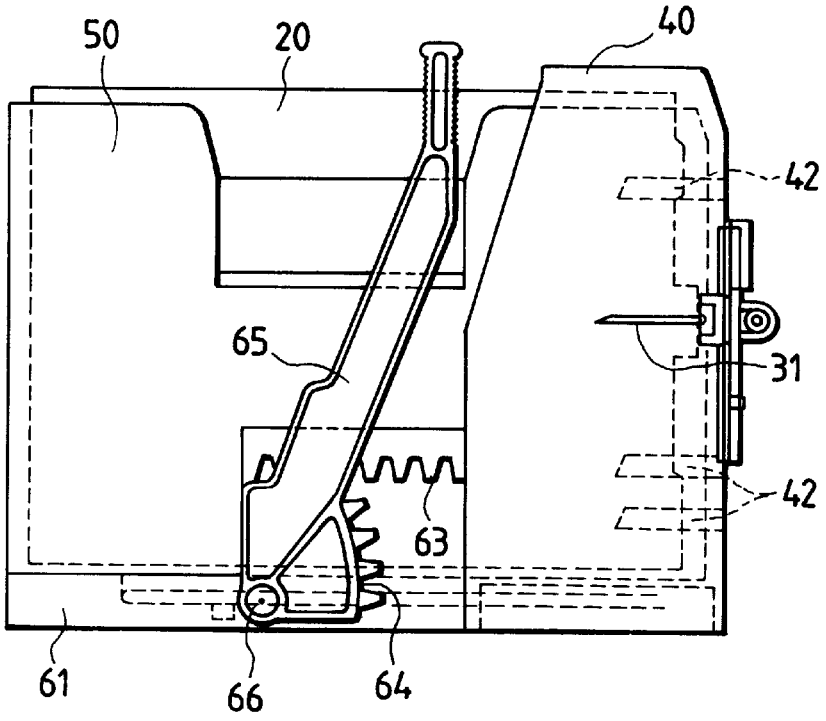

FIG. 5A and FIG. 5B illustrate a state of the ink cartridge loading mechanism 10 before the ink cartridge 20 is placed therein. FIG. 6A and FIG. 6B show a state before and a state after the ink cartridge 20 is placed into contact with the ink supply needle 31 by a slide mechanism 60.

Referring to the figures, the ink cartridge loading mechanism 10 comprises the ink cartridge loading section 30 for detachably placing the ink cartridge 20 therein. The loading section 30 comprises a hood section 40 having a side face to which the ink supply needle 31 is horizontally attached with the tip side of the ink supply needle 31 in an open state. Three positioning pins 42 project from the side face of the hood section 40 horizontally in the same direction as the ink supply needle 31. The loading section 30 comprises a box-shaped ink cartridge receptacle section 50 that can slide to the hood section 40 in the axial direction of the ink supply needle 31, namely, in the horizonal direction. It further comprises a slide mechanism 60 for sliding the receptacle section 50 in the horizontal direction.

The box-shaped receptacle section 50 has an opening 51 on the top and the ink cartridge 20 can be placed in the receptacle section 50 in the vertical direction from the top of the upper opening 51. That is, the ink cartridge 20 can be accepted from the direction roughly orthogonal to the ink supply needle 31. The receptacle section 50 is formed on a front end face 52 with an opening 52*d* and positioning holes 52*e* at the positions matching the needle insertion hole 23*d* and the three ink cartridge positioning holes 23*e* made in the front end face 23 of the ink cartridge 20.

A lid 53 is attached to the upper opening 51 of the receptacle section 50. It can pivot downward (in the ink cartridge acceptance direction) about a pivot 53*a* on one side of the receptacle section 50 and is normally biased in the direction of closing the lid 53 by a spring force indicated by the arrow F. When the lid 53 is closed, the tip thereof is fitted into an engagement groove 54 made on the side face of the receptacle section 50 in a locked state. A protrusion 25 that can move the engagement groove 54 in a lateral direction is formed on the bottom side face of the ink cartridge 20. Therefore, if the ink cartridge 20 is pushed from the top thereof, the protrusion 25 causes the formation portion of the engagement groove 54 to elastically move, unlocking the lid. After this, the lid 53 pivots downward together with the ink cartridge 20 and is pushed against the side face of the receptacle section 50. As the ink cartridge 20 is pulled up from the receptacle section 50, the lid 53 pivots upward by a spring force accordingly and again is restored to the locked state shown in FIG. 5B.

The slide mechanism 60 for sliding the receptacle section 50 has a guide frame 61 slidably supporting the receptacle section 50 and the guide frame 61 is formed with a rail groove 62 into which a guide rail 56 formed along the bottom face of the receptacle section 50 is fitted slidably. A rack 63 is formed on the side face of the receptacle section 50 downward toward the slide direction. A pinion 64 is rotatably attached to the side of the guide frame 61 in an engagement state with the rack 63. An operation lever 65 extends to the side face of the pinion 64 almost radially from a pivot center 66 of the pinion 64.

Referring to FIG. 5 and FIG. 6, the loading operation of the ink cartridge 20 in the ink cartridge loading mechanism 10 of the illustrated embodiment of the invention will be discussed.

As shown in FIG. 5A and FIG. 5B, with the ink cartridge receptacle section 50 drawn out from the hood section 40, the ink cartridge 20 is pushed into the upper opening 53 of the receptacle section 50 as indicated by the arrow from the top. As a result, the lid 53 is pushed inwardly and opened, allowing the ink cartridge 20 to be accepted therein. In this state, the needle hole 23*d* and the three positioning holes 23*e* made in the front end face 23 of the ink cartridge 20 match the opening 52*d* and the three positioning holes 52*e* made in the front end face of the receptacle section 50, respectively.

The position shown in FIG. 6A is thus attained. After this, the operation lever 65 falling to the side is rotated upward, whereby the receptacle section 50 in which the ink cartridge 20 is placed moves in the horizontal direction toward the side of the device where ink supply needle 31 is positioned.

When the operation lever 65 is completely raised, the front end face 52 of the receptacle section 50 abuts the side face of the hood section 40. As operation lever 65 is raised, the three positioning pins 42 are inserted into the positioning holes 52*e* in the front end face of the receptacle section and the positioning holes 23*e* in the front end face of the ink cartridge, so that the ink cartridge 20 is guided and positioned by the positioning pins 42. The ink supply needle 31 projecting horizontally also passes through the opening 52*d* in the front end face of the receptacle section and the needle hole 23*d* in the front end face of the ink cartridge 20 and is completely inserted into the ink supply port 22 inside the ink cartridge. As a result, the ink supply channel from the ink cartridge 20 to the ink jet head 8 is completed.

To replace the ink cartridge 20 with a new one after it is empty, the operation may be reversed. That is, the operation lever 65 in the position shown in FIG. 6B is rotated counterclockwise, towards the rear of the device. As a result, the receptacle section 50 slides to the rear and the upper opening 53 thereof is completely drawn out from the hood section 40. That is, the position shown in FIG. 6A results. After this, both side faces of the ink cartridge 20 exposed from notches 57*a* and 57*b* made in both side faces of the receptacle section 50 may be grasped and be drawn out upward, which is perpendicularly to the sliding direction resulting from the rotation of operation lever 65.

An alternative embodiment of an ink cartridge loading mechanism of the invention will now be discussed with reference to FIGS. 7A and 7B.

Figure 7A:
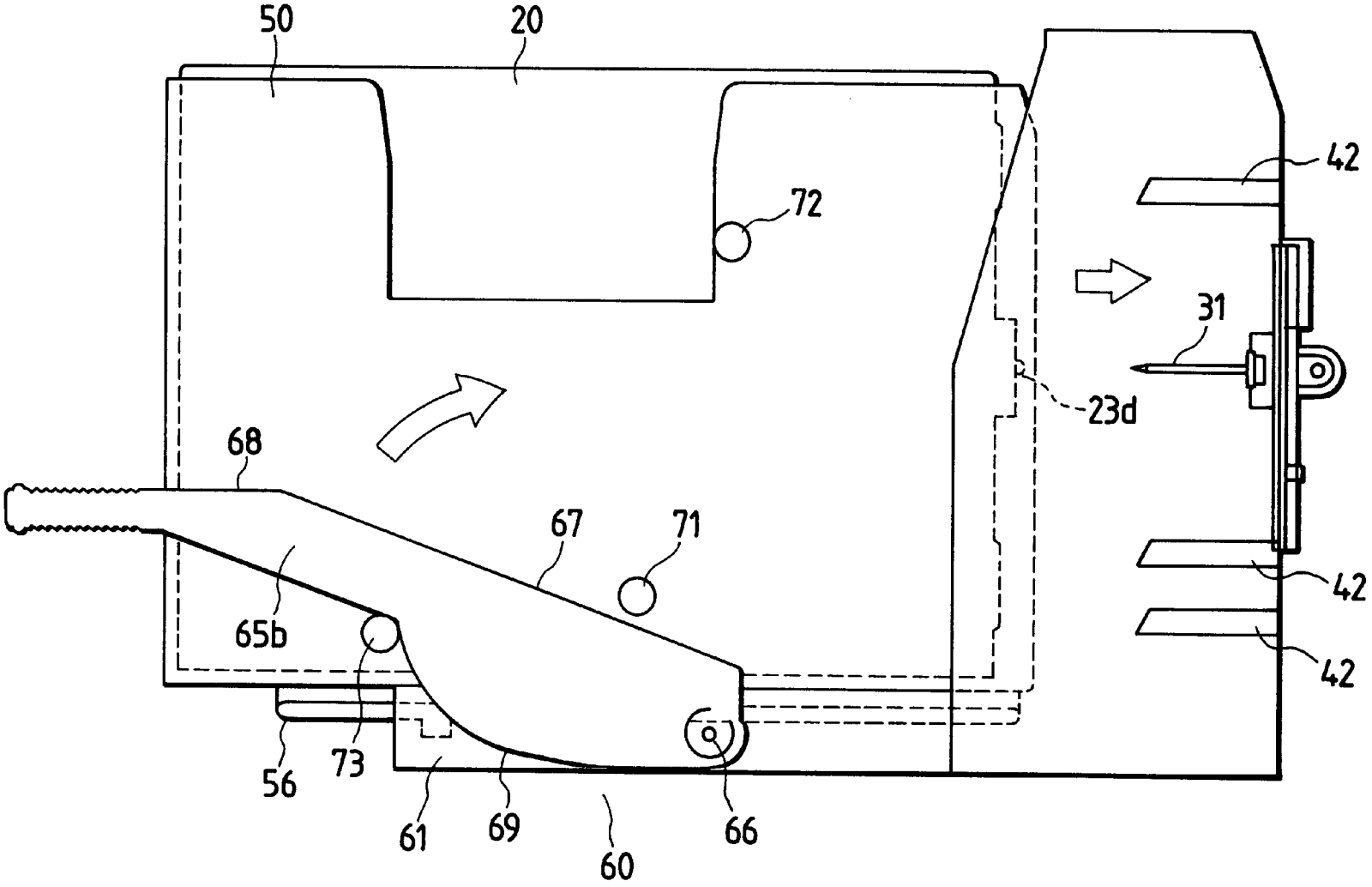
FIGS. 7A and 7B are schematic representations to explain an ink cartridge loading operation in a second embodiment of an ink cartridge loading mechanism.
Figure 7B:
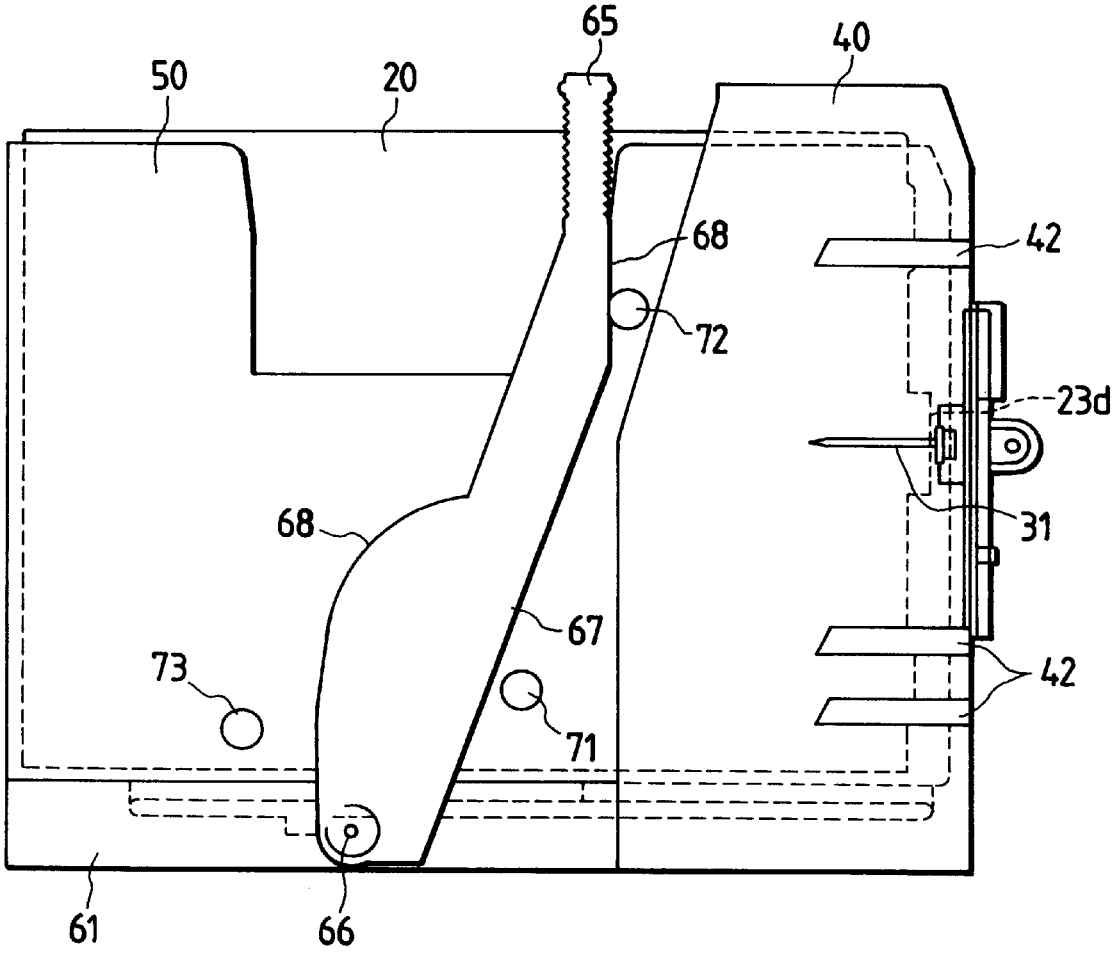

FIG. 7A and FIG. 7B show a position before and a position after an ink cartridge 20 slides to the side of the device toward an ink supply needle 31 by the action of a slide mechanism. Parts identical with or similar to those previously described with reference to FIG. 5 and FIG. 6 are denoted by the same reference numerals in FIG. 7A and FIG. 7B and will not be discussed again.

Protrusions 71, 72, and 73 are formed on the side face of an ink cartridge receptacle section 50 of the ink cartridge loading mechanism of the embodiment. They are placed at proper positions on the side face of the ink cartridge receptacle section 50 so that when an operation lever 65*b* is pivoted with a pivot center 66 as a supporting point, it abuts the protrusions 71, 72, and 73 and pushes them, whereby the ink cartridge receptacle section 50 moves horizontally.

A slide mechanism 60 for sliding the receptacle section 50 has a guide frame 61 slidably supporting the receptacle section 50 and the guide frame 61 is formed with a rail groove 62 into which a guide rail 56 formed along the bottom face of the receptacle section 50 is fitted slidably, as in the first embodiment.

The loading operation of the ink cartridge 20 in the ink cartridge loading mechanism of the second embodiment of the invention will now be discussed.

FIG. 7A shows a state in which the ink cartridge receptacle section 50 is drawn out from a hood section 40 and the ink cartridge 20 is placed into ink cartridge receptacle section 50 from the top. After this, the operation lever 65*b*, illustrated as falling to the side, is rotated upward, whereby the receptacle section 50 in which the ink cartridge 20 is placed slides horizontally toward the side having the ink supply needle 31.

That is, if the operation lever 65*b* is raised clockwise, in the direction of the arrow, first a side face 67 of the operation lever 65*b* abuts the protrusion 71. If the operation lever 65*b* is raised further, the side face 67 of the operation lever 65*b* pushes the protrusion 71, whereby the receptacle section 50 slides in the direction of the arrow along the rail groove 62 into which the guide rail 56 formed along the bottom face of the receptacle section 50 is fitted.

If the operation lever 65*b* is raised still further, an upper side face 68 of the side face 67 of the operation lever 65*b* contacts and pushes the protrusion 72. If the operation lever 65*b* is completely raised, a front end face 52 of the receptacle section 50 abuts the side face of the hood section 40, as shown in FIG. 7B. In this position, the ink supply needle 31 projecting horizontally passes through an opening 52*d* in the front end face of the receptacle section and a needle hole 23*d* in the front end face of the ink cartridge 20 and is completely inserted into the ink supply port 22 inside the ink cartridge. As a result, an ink supply channel from the ink cartridge 20 to an ink jet head 8 is completed.

During this operation, three positioning pins 42 are inserted into positioning holes 52*e* in the front end face of the receptacle section and positioning holes 23*e* in the front end face of the ink cartridge, as in the first embodiment.

To replace the ink cartridge 20 with a new one after it is empty, the operation is reversed. That is, the operation lever 65*b* in the position shown in FIG. 7B is rotated counterclockwise, towards the rear of the device. As a result a side face 69 opposed to the side face 67 of the operation lever 65*b* pushes the protrusion 73 for sliding the receptacle section 50 to the rear. If the operation lever 65*b* is completely brought down, an upper opening 53 of the receptacle section 50 is completely drawn out from the hood section 40. That is, the position shown in FIG. 7A results. After this, both side faces of the ink cartridge 20 exposed from notches 57*a* and 57*b* made in both side faces of the receptacle section 50 may be grasped and be drawn out upward, which is perpendicularly to the sliding direction resulting from the rotation of operation lever 65.

In this embodiment, the cartridge receptacle section is formed with the protrusions and the operation lever pushes the protrusions for sliding the cartridge receptacle section. However, the invention is not limited to this embodiment and various other slide mechanisms can be adopted. For example, the operation lever may be formed with a protrusion (cam follower) and the cartridge receptacle section may be formed with a groove-like cam engaging the protrusion, so that a mechanism of sliding the cartridge receptacle section in response to rotation of the operation lever may be used to convert the rotation of the operation lever into linear motion sliding the cartridge receptacle section.

Thus, with the ink cartridge loading mechanism of a printer, an ink cartridge is placed from a direction different from the direction of alignment of ink supply needle and then is slidingly moved toward the direction of the ink supply needle, thereby completing loading of the ink cartridge. Thus, the space in the loading direction can be lessened as compared with the loading mechanism for placing an ink cartridge from one direction as in the prior art.

Therefore, a printer comprising the ink cartridge loading mechanism of the invention does not require a large space on the front or rear side of the printer, there are fewer restrictions on the location of the printer and the printer does not require a large amount of space to accommodate replacing the ink cartridge.

What is claimed is:

1. An ink cartridge loading mechanism for loading an ink cartridge with a printer, comprising:

said ink cartridge having an ink supply port, an ink supply needle for connecting with said ink supply port of the ink cartridge, said needle being disposed in a first direction;

a receptacle for accepting the ink cartridge in a direction different from the first direction; and a slide mechanism for causing said receptacle to reciprocate so that said ink supply needle is inserted into the ink supply port of the ink cartridge.

2. The ink cartridge loading mechanism as claimed in claim 1, wherein the second direction is a direction substantially orthogonal to the first direction.

3. The ink cartridge loading mechanism as claimed in claim 1 or 2, wherein said slide mechanism comprises:

a guide frame for slidably supporting said receptacle;

an operation lever formed pivotably on a side of said guide frame; and a mechanism for converting rotation of said operation lever into linear motion sliding said receptacle.

4. The ink cartridge loading mechanism as claimed in claim 1 or 2, wherein said slide mechanism comprises:

a guide frame for slidably supporting said receptacle;

a rack formed on a side of said receptacle;

a pinion being formed on a side of said guide frame and engaging said rack; and an operation lever extending radially from a rotation center of said pinion for rotating said pinion.

5. The ink cartridge loading mechanism as claimed in claim 1 or 2, wherein said slide mechanism comprises:

a guide frame for slidably supporting said receptacle;

a protrusion formed on a side of said receptacle; and an operation lever being formed on a side of said guide frame and engaging said protrusion for sliding said receptacle.

6. The ink cartridge loading mechanism as claimed in claim 1 or 2, wherein said slide mechanism comprises:

a guide frame for slidably supporting said receptacle;

a groove-like cam formed on a side of said receptacle; and an operation lever being formed on a side of said guide frame and having a protrusion engaging said cam.

7. The ink cartridge loading mechanism as claimed in claim 1, wherein the ink cartridge comprises a flexible ink bag in which ink is sealed, the ink supply port made in said ink bag, and a hard case containing said ink bag.

8. The ink cartridge loading mechanism as claimed in claim 1, wherein said ink supply needle is placed horizontally.

9. The ink cartridge loading mechanism as claimed in claim 1 further including:

a lid attached to said receptacle for blocking an opening of said receptacle, wherein, said lid is openable;

a spring force biasing said lid in a direction blocking the opening;

an engagement section for holding said lid in a blocking direction, said engagement section being moveable in a direction so that an engagement between said engagement section and said lid is released as the ink cartridge is pushed into said receptacle.

10. An ink jet printer comprising a paper transport for transporting paper in a paper transport direction, an ink jet head adjacent a paper passage of said paper transport, said ink jet head being moveable in a direction orthogonal to the paper transport direction, an ink cartridge receptacle for removably receiving an ink cartridge in a first direction, an ink cartridge connector, a flexible ink conduit connecting said connector with said ink jet head, and a mechanism associated with said receptacle and capable of moving said receptacle in a second direction which is substantially different from said first direction between a first position for receiving the ink cartridge and a second position adjacent said connector.

11. The ink jet printer of claim 10 further comprising an ink cartridge within said receptacle, said ink cartridge having an ink port for engaging with said connector.

12. The ink jet printer as claimed in claim 11 wherein the ink cartridge comprises a flexible ink bag in which ink is sealed, the ink port made in said ink bag, and a hard case containing said ink bag.

13. The ink jet printer of claim 10 wherein said connector is a hollow ink supply needle.

14. The ink jet printer as claimed in claim 13 wherein said ink supply needle is placed horizontally.

15. The ink jet printer as claimed in claim 10 wherein second direction is generally orthogonal to said first direction.

16. The ink jet printer as claimed in claim 10 further comprising a guide for supporting said receptacle and a mechanism attached to said guide for moving said receptacle in the second direction.

17. The ink jet printer as claimed in claim 16 wherein said guide further comprises an operation lever pivotably attached to said guide, and a mechanism for converting rotation of said operation lever into linear motion sliding said receptacle section.

18. The ink jet printer as claimed in claim 16 wherein said guide further comprises a rack formed on said receptacle, a pinion being pivotably attached to said guide and engaging said rack, and an operation lever extending radially from said pinion for rotating said pinion.

19. The ink jet printer as claimed in claim 16 wherein said guide further comprises protrusion formed on a side of said receptacle, and an operation lever being attached to said guide and engaging said protrusion for moving said receptacle.

20. The ink jet printer as claimed in claim 16 wherein said guide further comprises a groove-like cam formed on a side of said receptacle section, and an operation lever being attached to said guide and having a protrusion engaging said cam.

21. The ink jet printer as claimed in claim 10 further comprising a lid attached to said receptacle for blocking an opening of said receptacle, wherein said lid is openable;

a spring force biasing said lid in a direction blocking said opening;

an engagement section for holding said lid in a blocking direction, said engagement section being moveable in a direction so that an engagement between said engagement section and said lid is released as an ink cartridge is pushed into said receptacle.

* * * * *